United States Patent [19]

Simo

[11] Patent Number: 5,063,678

[45] Date of Patent: Nov. 12, 1991

[54] ARCHERY BOW SIGHT, MOUNT AND QUIVER HOLDER

[76] Inventor: Miroslav A. Simo, 370 N. Delaplaine Rd., Riverside, Ill. 60546

[21] Appl. No.: 46,395

[22] Filed: Apr. 6, 1987

[51] Int. Cl.[5] ..... F41G 1/00

[52] U.S. Cl. ..... 33/265

[58] Field of Search ..... 33/265; 124/87

[56] References Cited

U.S. PATENT DOCUMENTS

| | | | |
|---|---|---|---|
| 1,295,075 | 2/1919 | Sheppard . | |
| 1,476,884 | 12/1923 | Gregory . | |
| 2,277,961 | 3/1942 | Detmer . | |
| 2,642,661 | 6/1953 | Fredrickson | 124/87 |
| 2,767,472 | 10/1956 | Kocur | 33/265 |
| 2,900,973 | 8/1959 | Diehr | 33/265 X |
| 2,968,489 | 1/1961 | Doniger . | |
| 3,063,151 | 11/1962 | Hanson | 33/265 |
| 3,136,063 | 6/1964 | Stebbins | 124/87 |
| 3,961,423 | 6/1976 | Hrebar . | |
| 4,215,871 | 8/1980 | Hirsch et al. . | |
| 4,294,222 | 10/1981 | Pelsue | 124/87 X |
| 4,328,625 | 5/1982 | Carella | 33/265 X |
| 4,386,598 | 6/1983 | Blaser . | |
| 4,418,479 | 12/1983 | Stachnik | 33/265 |
| 4,542,731 | 9/1985 | Quartino . | |
| 4,697,350 | 10/1987 | Shepley et al. | 33/265 |

*Primary Examiner*—William A. Cuchlinski, Jr.
*Assistant Examiner*—Alvin Wirthlin
*Attorney, Agent, or Firm*—Speckman & Pauley

[57] ABSTRACT

An archery bow sight comprising a sight mount attachable to an archery bow, a sight pin retaining sleeve adjustable by means of a mounting nut in a slot in the sight mount, and a sight pin adjustably retained in the sight pin retaining sleeve is provided. The generally V-shaped sight configuration of the sight pin provides improved target sighting and the sight pin retaining sleeve permits sight pin replacement without requiring realignment in either the vertical or horizontal adjustment plane. An optional protector is provided to shield the sight pin and retaining sleeve from direct blows, and an optional quiver attachment feature allows pivotable mounting of the quiver directly on the sight mount.

26 Claims, 2 Drawing Sheets

ARCHERY BOW SIGHT, MOUNT AND QUIVER HOLDER

BACKGROUND OF THE INVENTION

1. Field of the Invention

This invention relates to an archery bow sight comprising a sight mount attachable to an archery bow, a sight pin retaining means attachable and adjustable in at least one slot in the sight mount, and a sight pin adjustably retained in the sight pin retaining means. A sight pin protector may be provided to shield the sight pin and the sight pin retaining means from direct blows to prevent the sight pin from becoming bent, broken or misaligned. In addition, the sight mount may be provided with an adjustable quiver attachment feature whereby the quiver is attachable to the sight mount in a pivotable fashion to provide rotatable adjustment from an upright position. The sight pin of the present invention provides improved target sighting due to its generally V-shaped configuration. The sight pin retaining means of the present invention provides for replacement of a damaged sight pin without requiring realignment in either the horizontal or the vertical adjustment plane.

2. Description of the Prior Art

Archery bow sights provided with sight pins adjustable in at least one plane are used by archery enthusiasts, particularly hunters, for improved sighting of the target. Sight pins used with archery bow sights are generally adjustable in two planes which are substantially perpendicular with respect to one another. Sight pins are generally adjustable in a vertical plane to compensate for the distance to the target and are adjustable in a horizontal plane to compensate for windage.

There are two conventional types of sight pins presently used with archery bow sights. One has a threaded shaft with a solid sphere sight configuration at one end, and the other has a threaded shaft with a hollow ring sight configuration at one end. In using the sight pin comprising a solid sphere, the solid sphere is superimposed over the desired target for sighting. This prior art sight pin however, covers too large an area, and small or distant targets, in particular, may be entirely blocked out by the spherical sight. The second type of sight pin which has a full circle sight configuration is too difficult to steady up and contributes to more movement than desired and inexact centering of the target within the ring. The prior art sight pins are inadequate for accurately sighting distant and/or small targets.

Several prior art patents relate to gun sights, which are somewhat different in principle than archery bow sights since archery bow sights are single sights while gun sights are generally two sights, one rear sight and one front sight, both of which move with movement of the gun. U.S. Pat. No. 3,961,423 teaches a secondary sighting system for use on a rifle when the primary telescopic sight is inoperable, the secondary sighting system comprising a bead-type front sight and an open notch rear sight. U.S. Pat. No. 1,476,884 teaches several configurations for gun sights, the optical effect of which is to create a sight bead. This type of sight is impractical in operation because each sight must be adjusted before use to fit the interpupillary distance of the user. U.S. Pat. No. 1,295,075 teaches a pendulum-type sighting device which is insertable into the bore of a rifle to aid alignment of the permanent sights. Round sighting apertures are used to align the permanent multiple sights on the barrel of the rifle. U.S. Pat. No. 4,386,598 teaches a sling shot providing alignment of front and rear sights.

The shaft of prior art sight pins is generally threaded and threadedly engaged through an internally threaded retaining sleeve of a sight pin retaining means. When the sight pin retaining means is fixed on the sight mount, the sight pin is adjustable in a horizontal plane by screwing the sight pin into or out from the threaded retaining sleeve. A locking nut may be provided to securely retain the threaded sight pin on the threaded retaining sleeve and to lock the sight pin at the desired horizontal adjustment. The threaded sleeve is also provided with means for mounting and retaining the sight pin retaining means at the desired vertical position on a sight mount attachable to an archery bow. If the prior art sight pin and/or sight pin retaining means becomes damaged and must be replaced, the sight pin must be unscrewed from the threaded sleeve and the locking nut, and a new sight pin re-threaded in the sight pin retaining means. The new sight pin, however, cannot be installed in precisely the same horizontal alignment as the sight pin it replaced, except by inaccurate methods, such as by counting the number of turns or approximately measuring the length of the sight pin projecting from the retaining means. Whenever this type of sight pin is replaced in the field, the new sight pin must be readjusted in the horizontal position to achieve, as best as possible, the horizontal alignment of the sight pin it replaced.

Several prior art patents relate generally to tools having replaceable bits. U.S. Pat. No. 2,968,489 teaches a cutting tool with a blade chuck for gripping a blade which is retractable into the handle of the tool. Locking of the blade at various projection distances from the handle is made possible by a locking sleeve arrangement. U.S. Pat. No. 2,277,961 teaches a brace for bits and the like having smooth shanks. Shoulders on the stem of the tool abut a shoulder in the chuck to limit the extent to which the tool may be inserted into the chuck. U.S. Pat. No. 4,215,871 teaches a hand-held collet with a plurality of jaw pieces mounted on the ends of steel rods. Unscrewing the collet collar forces the jaw pieces apart due to the force exerted by the steel rods, and thereby releases the tool. U.S. Pat. No. 4,542,731 discloses a vertically and horizontally adjustable arrow support and an arrangement whereby the projection of an arrow spacing plunger is adjustable, and the horizontal placement of the plunger may be locked.

SUMMARY OF THE INVENTION

It is an object of the present invention to provide an archery bow sight comprising an improved sight pin which provides accurate target sighting.

It is another object of the present invention to provide an archery bow sight wherein a sight pin may be removed and a replacement sight pin installed retaining both the vertical and horizontal adjustment positions of the sight pin it replaced.

It is yet another object of the present invention to provide an archery bow sight mount which additionally provides an adjustable quiver attachment feature, so that the quiver can be mounted in positions parallel and non-parallel to the bowstring.

The sight pin and sight pin retaining means of the present invention are structurally different from the prior art sight pins and retaining means, and provide significant advantages over the prior art arrangement.

For example, the sight pin of the present invention preferably has a smooth shaft and the sight pin retaining means preferably has a split jaws arrangement which tightens around the smooth shaft of the sight pin and allows adjustment of the sight pin by loosening and retightening the split jaws. The present invention may also be provided with a lateral sight pin lock which allows removal of a damaged sight pin from the retaining means, and replacement with a new sight pin in precisely the same horizontal adjustment position as the sight pin it replaced.

The sight pin of the present invention preferably has a smooth, cylindrical shaft with a sight at one end having the configuration of a truncated V with a smooth rounded contour at the base of the V or a straight horizontal contour at the base of the V. This sight configuration provides accurate sighting of the target at the base of the truncated V, the narrow width at the base of the V permitting cradling of the target while the target is still visible. The width of the base of the truncated V is as required to cradle the entire target and thus may be different for different target sizes. Improved sighting is provided with a sight pin of this configuration since the sight is not superimposed over the target, thereby blocking the target, and the target can be accurately cradled in the base of the V. To facilitate sighting at the base of the V-shaped sight, the base of the V may be color coded in a small area to contrast with the angled sides of the sight.

The sight pin retaining means of the present invention comprises an externally and at least partially internally threaded sleeve. One end of the threaded retaining sleeve is preferably provided with a split jaws arrangement comprising a plurality of jaws arranged in a regular radial fashion around the internal bore of the sleeve. The interior faces of the jaws form an approximately cylindrical bore in the tightened condition, while the exterior faces form an approximately conical contour when the split jaws are in a tightened condition. The smooth shank of the sight pin may be inserted through the open split jaws, and the split jaws are subsequently tightened on the sight pin shank by means of a tightening nut. The tightening nut is provided with internal threads mating with the external threads of the threaded retaining sleeve and a smooth, internally conical section at one end to tighten the split jaws around the shank of the sight pin as the tightening nut is turned onto the retaining sleeve.

The sight pin retaining means of the present invention further comprises a mounting nut threadedly engaged on the external threads of the retaining sleeve, the mounting nut having a larger, preferably circular, cross-sectional configuration at its front portion and having at least two flattened sides arranged parallel with respect to one another on its rear portion. The flattened sides of the mounting nut are dimensioned to fit slidably in at least one slot in the sight mount. The sight pin retaining means is vertically adjustable within slots in the sight mount by sliding the flattened sides of the mounting nut in the slots. The sight pin retaining means is supported and retained in sight mount slots by the larger cross-sectional portion of the mounting nut on one side of the slot and on the other side by a locknut which may screwed onto the external threads of the threaded retaining sleeve to lock the sight pin retaining means in a vertical adjustment position in a slot of the sight mount by tightening against the mounting nut and/or the sight mount. The depth of the flattened portion of the mounting nut preferably corresponds to just less than the depth of the slot in the sight mount so that the flattened sides of the mounting nut provide surface contact with the walls of the slot. Washers may be provided to adapt the mounting nut to shallower slot depths.

Since the mounting nut is screwedly retained on the sight pin retaining means, once the sight pin retaining means is mounted in a slot of the sight mount, the length of the retaining sleeve projecting from the slot and thus, the horizontal adjustment of the sight pin may be changed simply by loosening the lock nut and turning the threaded retaining sleeve with respect to the mounting nut. The present invention thus provides at least two means of adjusting the horizontal position or the extension of the sight pin: (1) adjusting the length of the sight pin extending from the internal bore of the threaded sleeve, by loosening the locking split jaws and repositioning the sight pin, and (2) adjusting the threaded retaining sleeve with respect to the mounting nut while the sight pin remains fixed.

The sight pin retaining means of the present invention may also be provided with a horizontal sight pin lock and locking nut which facilitate replacement of a sight pin, and provide installation of a replacement sight pin in precisely the same adjustment position as the sight pin it replaced. The horizontal sight pin lock is externally threaded to engage the internally threaded bore of the opposite end of the retaining sleeve from the projecting sight pin and preferably has a head to facilitate adjustment. In operation, when the sight pin has been horizontally adjusted to the desired degree in the sight pin retaining means and protrudes therefrom at the desired distance, the horizontal sight pin lock is screwed into the internal threaded bore of the opposite end of the retaining sleeve until it seats against the end of the sight pin. A locking nut having an internally threaded bore mating the external threads of the horizontal sight pin lock is then tightened against the threaded retaining sleeve to maintain the lateral sight pin lock in the desired fixed horizontal position. If the sight pin becomes damaged or bent, the tightening nut on the split jaws may be loosened, the damaged sight pin removed, a new sight pin inserted until it seats against the end of the the horizontal sight pin lock, and the tightening nut tightened to securely retain the sight pin in the split jaws. In this fashion, sight pins with the same length shanks may be interchanged without requiring readjustment in either the vertical or horizontal adjustment position.

The sight mount of the present invention comprises means for attachment of the sight mount to the archery bow and provides at least one slot for vertically adjustable mounting of the sight pin retaining means. At least one slot is provided for adjustable attachment of the sight mount to the bow, by fastening means such as screws. A sight pin protector may be provided to shield the protruding sight pin and sight pin retaining means by attaching a generally U-shaped rigid protector to the sight mount, the protector dimensioned to accommodate the number and arrangement of slots provided for mounting the sight pin retaining means and to provide sufficient clearance for all desired horizontal adjustments of the sight pin. In addition, the sight mount of the present invention provides a quiver attachment feature whereby the quiver may be pivotably attached to the sight mount by fastening means at one fixed attachment point and an arcuate attachment slot which enables limited rotation of the quiver about the fixed quiver attachment point.

BRIEF DESCRIPTION OF THE DRAWINGS

The above mentioned and other features of the present invention and the manner of obtaining them will become apparent, and the invention itself will be best understood by reference to the following description of the invention read in conjunction with the accompanying drawings, in which.

DESCRIPTION OF PREFERRED EMBODIMENTS

Figure 1:
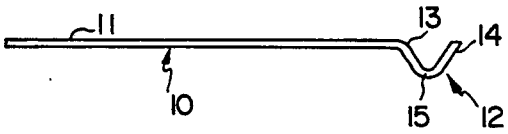
FIG. 1 shows a side view of a preferred embodiment of the sight pin of the present invention.
Figure 1A:
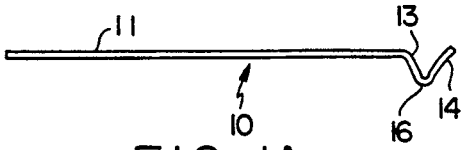
FIG. 1A shows a side view of another preferred embodiment of the sight pin of the present invention.

Sight pin 10, as shown in FIGS. 1 and 1A, preferably comprises a smooth shank portion 11 with truncated V-shaped sight 12 at one end thereof. Sight 12 preferably comprises two angled sides 13 and 14 joined by curved base portion 15 as shown in FIG. 1, or straight horizontal base portion 16 as shown in FIG. 1A. Sight 12 is preferably integral with shank 11, and sight 12 may be provided with a colored portion at curved base portion 15 or straight base 16 to distinguish the base portion from the angled sides to provide improved sighting at the base portion. Sight pin 10 preferably comprises a rigid material such as steel or aluminum and rigid polymeric materials may also be used.

Figure 2:
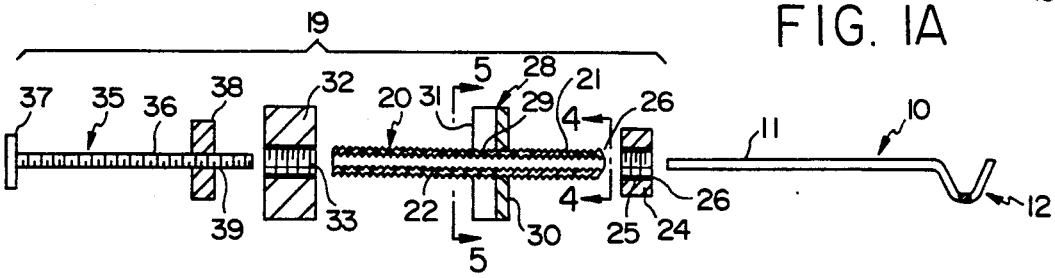
FIG. 2 shows an exploded side view of the sight pin retaining means and sight pin of the present invention.
Figure 3:
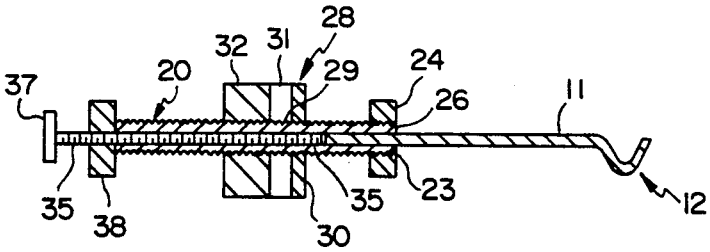
FIG. 3 shows a cross-sectional side view of an assembled sight pin retaining means with a sight pin horizontally adjusted therein.
Figure 4:
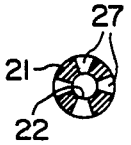
FIG. 4 shows a cross-sectional view of the split jaws of the sight pin retaining means along line 4—4 of FIG. 2.

Sight pin 10 is mounted and horizontally adjustable within sight pin retaining means 19 as shown in FIGS. 2 and 3. Sight pin retaining means 19 comprises retaining sleeve 20 with external threads 21, internal threaded bore 22, locking split jaws arrangement 23 at one end, and is provided with a plurality of nuts threadedly engaged thereon. Locking split jaws arrangement 23, as shown more clearly in FIG. 4, comprise a plurality of jaws 27 having generally smooth surfaces, the inwardly facing surfaces of jaws 27 sized and configured to accommodate and retain shank 11 of sight pin 10 and to form a substantially cylindrical bore when in the closed condition, and the outwardly facing surfaces of jaws 27 providing a roughly conical or frustoconical configuration when in the closed position. Tightening nut 24 has internal threads 25 threadedly engageable with external thread 21 of retaining sleeve 20 and smooth conical locking portion 26 having mating configuration with the outwardly facing surfaces of jaws 27. When tightening nut 24 is tightened against locking split jaws arrangement 23, sight pin 10 is securely retained in internal bore 22 of retaining sleeve 20. Tightening nut 24 need not be unscrewed from retaining sleeve 20 entirely to release split jaws arrangement 23 for horizontal adjustment of sight pin 10.

Figure 5:
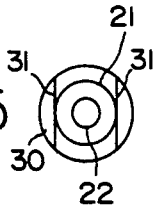
FIG. 5 shows a cross-sectional view of the mounting nut of the present invention along line 5—5 of FIG. 2.

Mounting nut 28 has internal threads 29 mating with external threads 21 of retaining sleeve 20. Mounting nut 28 has a circular cross-sectional portion 30 and a portion with at least two flattened sides 31 sized to fit within slots of a sight mount, as shown more clearly in FIG. 5. Mounting nut 28 is threaded onto retaining sleeve 20 with circular portion 30 closest to locking split jaws arrangement 23 and sight pin 10 and the portion of mounting pin 28 having flattened sides 31 facing away from sight pin 10. Lock nut 32 having internal threads 33 matable with external threads 21 of retaining sleeve 20 may be screwed onto threaded sleeve 20 until it seats against the sight mount, thereby locking mounting nut 28 in place on the retaining sleeve 20 and locking retaining sleeve 20 in position in a slot of the sight mount.

Horizontal sight pin lock 35 comprises pin 36 having external threads matable with internal threaded bore 22 of retaining sleeve 20 and head 37 which preferably is larger than the diameter of retaining sleeve 20. Locking nut 38 with internal threads 39 matable with external threads of pin 36 is provided to lock horizontal sight pin 36 in position by tightening locking nut lock 38 until it seats against the end of retaining sleeve 20.

FIG. 3 shows sight pin retaining means 19 assembled with sight pin 10 horizontally adjusted and locked therein. Horizontal adjustment of sight pin 10 is achieved by changing the length of sight pin shank 11 protruding from sight pin retaining means 19. Sight pin 10 is horizontally adjustable simply by loosening tightening nut 24 to release locking split jaws arrangement 23 and horizontally adjusting sight pin 10 within bore 22 of retaining means 19. As shown in the FIG. 3, horizontal sight pin lock 35 may be advanced within internal threaded bore 22 until it seats against the end of sight pin 10 after sight pin 10 has been horizontally adjusted to the desired adjustment position. Locking nut 38 is then tightened until it seats against the end of retaining sleeve 20, thereby locking horizontal sight pin lock 35 in position. This arrangement permits removal of sight pin 10 by release from split jaws arrangement 23 and replacement with a new sight pin, the replacement sight pin retaining precisely the same horizontal adjustment position within retaining sleeve 20.

Figure 6:
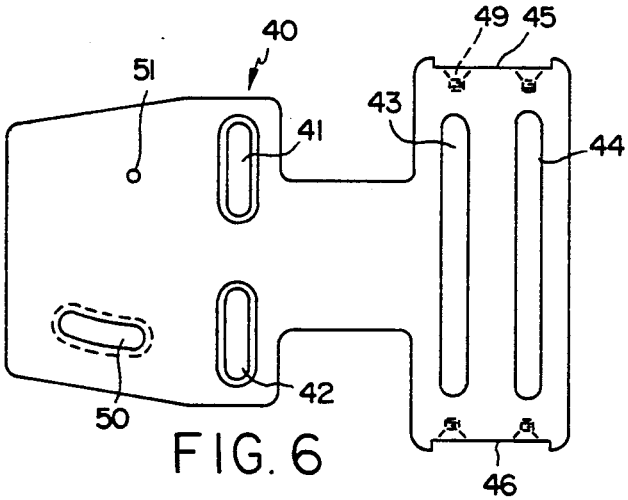
FIG. 6 shows a side view of one embodiment of a sight mount according to one embodiment of the present invention.
Figure 8:
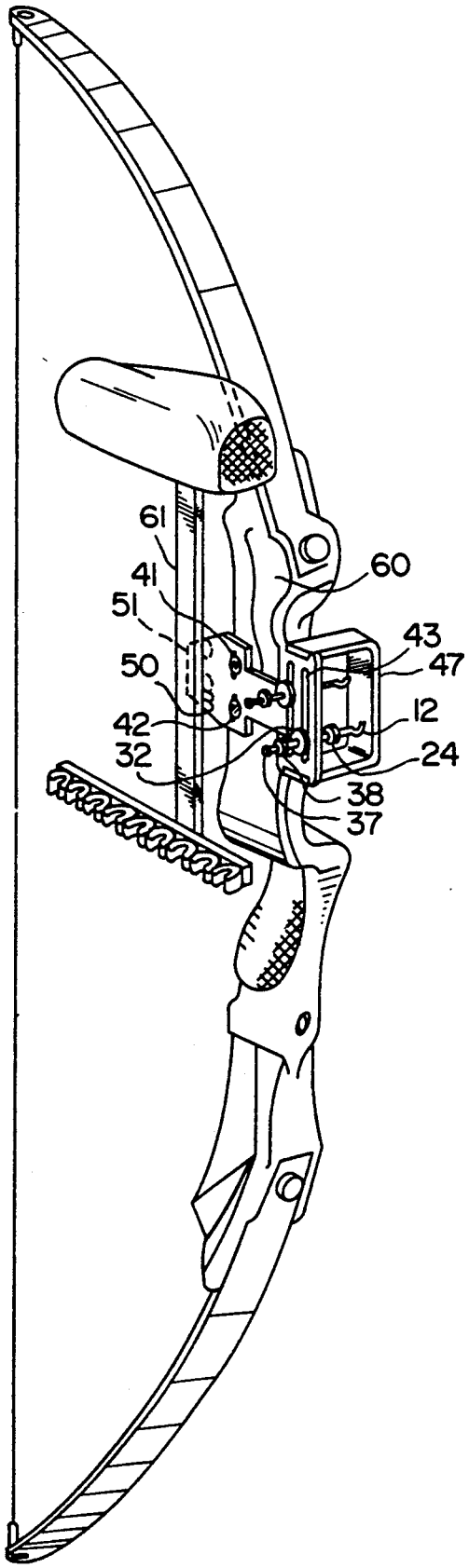
FIG. 8 shows a perspective of an archery bow sight with a quiver attached according to this invention attached to a bow.

Sight mount 40, shown in FIG. 6, is attached to the side of an archery bow 60 by fastening means extending through slots 41 and 42 and anchoring the sight means to the bow as is well known to the art and as shown in FIG. 8. Sight mount 40, when mounted on a bow, extends generally vertically with respect to the ground when the bow is in a shooting position. Slots 43 and 44 match the dimensions of flattened sides 31 of mounting nut 28, so that sight pin retaining means 19 is slidable within slots 43 and 44 to provide vertical adjustment, and may be securely retained at a desired vertical adjustment position in slots 43 and 44 by means of lock nut 32. Slots 43 and 44 are shown as vertically directed slots, but different orientations, such as obliquely directed slots, may be provided for specific uses. Sight pin 10 is vertically adjustable to compensate for the distance to the target simply by loosening lock nut 32 and sliding flattened sides 31 of mounting nut 28 in slots 43 and/or 44. Multiple sight pins with their retaining means may be provided in one or both of slots 43 and 44 to provide appropriate sights for targets at different distances and to compensate for different windages. Typically, several sight pins with sight pin retaining means are retained on sight mount 40 at different horizontal and vertical adjustments for different target distances and windages.

Sight mount 40 also provides mounting means for a quiver, including a pivotal point of attachment 51 and quiver adjustment arcuate slot 50. A quiver 61 may be pivotally attached at attachment point 51, the quiver pivotable as determined by the length and direction of quiver adjustment arcuate slot 50. The quiver adjustment arcuate slot allows the archer to effectively shorten vertical space occupied by the quiver by tilting it, and provides more convenient access to the arrows.

Figure 7:
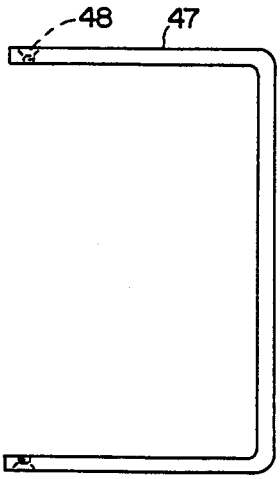
FIG. 7 shows a rear view of one embodiment of a sight pin protector for mounting on the sight mount of FIG. 6.

Sight pin protector 47 is generally U-shaped, as shown in FIG. 7. The ends of the U-shaped protector 47 are dimensioned to fit snugly within notches 45 and 46 in sight mount 40, and protector 47 is provided with bores 48 for attachment of protector 47 to sight mount 40 by suitable fastening means, such as screws which fasten into threaded bores 49 in sight mount 40. As shown in FIG. 7, bores 48 are preferably enlarged toward the outer portion so that a screw head, or the like, may be recessed therein. Protector 47 is dimensioned to provide clearance for all desired horizontal adjustment positions of the sight pins.

Some or all of the nuts threadedly engaged in or on sight pin retaining means 19 may be provided with knurled exterior surfaces, or the like, to facilitate hand tightening and loosening of the nuts. Likewise, some or all of the nuts may be provided with flattened surfaces to facilitate tightening and loosening by mechanical means such as a tool matching the exterior configuration of the nuts.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. An archery bow sight comprising:

a sight mount attachable to an archery bow, said sight mount having at least one sight mounting slot;

a sight pin retaining means comprising an externally threaded retaining sleeve with an internally threaded through bore, a mounting nut threadedly engaged with said retaining sleeve external threads and slidably adjustable in said at least one sight mounting slot, and a locknut threadedly engaged with said retaining sleeve external threads to securely retain said sight pin retaining means in said at least one sight mount slot at a vertical adjustment position; and a sight pin comprising a shank with a generally V-shaped sight at one end thereof adjustably retained in said sight pin retaining means at a horizontal adjustment position.

2. An archery bow sight according to claim 1 wherein said generally V-shaped sight comprises two angled sides joined by a curved base portion.

3. An archery bow sight according to claim 2 wherein said curved base portion is color-coded to distinguish said base portion from said angled sides.

4. An archery bow sight according to claim 1 wherein said generally V-shaped sight comprises two angled sides joined by a truncated base portion.

5. An archery bow sight according to claim 4 wherein said truncated base portion is color-coded to distinguish said base from said angled sides.

6. An archery bow sight according to claim 1 wherein said shank of said sight pin is smooth and cylindrical.

7. An archery bow sight according to claim 1 wherein said sight pin retaining means additionally comprises a locking split jaws retaining means at one end securely retaining said shank of said sight pin.

8. An archery bow sight according to claim 7 wherein said locking split jaws retaining means comprises a plurality of jaws arranged in a regular radial fashion around said through bore of said sight pin retaining means, the inwardly facing surfaces of said jaws configured to form a substantially cylindrical bore when in a closed condition, the outwardly facing surfaces of said jaws configured to form a substantially conical configuration when in said closed condition, and a tightening nut threadedly engaged with said retaining sleeve external threads and having a smooth conical locking portion at one end matching said configuration of said outwardly facing surfaces of said jaws whereby tightening of said tightening nut on said retaining sleeve external threads causes said conical locking portion of said tightening nut to seat against said locking jaws and force said jaws against said sight pin.

9. An archery bow sight according to claim 8 wherein said sight pin retaining means additionally comprises an externally threaded lateral sight pin lock threadedly engaged in said internally threaded bore of said retaining sleeve and a threaded locking nut threadedly engaged on said external threads of said lateral sight pin lock to retain said lateral sight pin lock in a set horizontal adjustment position.

10. An archery bow sight according to claim 1 additionally comprising a U-shaped sight pin protector attached to said sight mount and extending over said sight pin.

11. An archery bow sight according to claim 1 additionally comprising a quiver attachment means on said sight mount, said quiver attachment means comprising a fixed point of attachment and an adjustment slot for attachment of a quiver, whereby said quiver is pivotable around said fixed point of attachment by rotation in said adjustment slot.

12. An archery bow sight according to claim 1 comprising a plurality of sight pins and sight pin retaining means for mounting on said sight mount.

13. An archery bow sight according to claim 1 comprising a plurality of slot means in said sight mount.

14. In an archery bow sight of the type having a sight pin retained in a sight mount attachable to an archery bow, the improvement consisting of said sight pin having a generally V-shaped open sight at one end, said generally V-shaped open sight being the sole sight, and said generally V-shaped open sight comprising two angled sides joined by a curved base portion.

15. In an archery bow sight of claim 14 wherein said curved base portion is color-coded to distinguish said base portion from said angled sides.

16. In an archery bow sight of the type having a sight pin retained in a sight mount attachable to an archery bow, the improvement consisting of said sight pin having a generally V-shaped open sight at one end, said generally V-shaped open sight being the sole sight, and said generally V-shaped open sight comprising two angled sides joined by a truncated base portion.

17. In an archery bow sight of claim 16 wherein said truncated base portion is color-coded to distinguish said base from said angled sides.

18. In an archery bow sight of the type having a sight pin retained in a sight mount attachable to an archery bow, the improvement comprising said sight mount having a sight pin retaining means comprising an externally threaded retaining sleeve with an internally threaded through bore in which said sight pin is slidably engageable and a jaw means at one end of said internally threaded through bore capable of clamping said sight pin in a fixed position, and a threaded lateral sight pin lock threadedly engageable in the other end of said bore providing a lateral stop for locating said sight pin in a preset lateral adjustment position.

19. In an archery bow sight of claim 18 wherein said sight pin has a generally V-shaped open sight comprising two angled sides joined by a curved base portion.

20. In an archery bow sight of claim 19 wherein said curved base portion is color-coded to distinguish said base portion from said angled sides.

21. In an archery bow sight of claim 18 wherein said sight pin has a generally V-shaped open sight comprising two angled sides joined by a truncated base portion.

22. In an archery bow sight of claim 21 wherein said truncated base portion is color-coded to distinguish said base from said angled sides.

23. In an archery bow sight according to claim 18 wherein a shank of said sight pin is smooth and cylindrical.

24. In an archery bow sight according to claim 18 wherein said sight pin retaining means additionally comprises a locking split jaws retaining means at one end securely retaining a shank of said sight pin.

25. In an archery bow sight according to claim 18 wherein said locking split jaws retaining means comprises a plurality of jaws arranged in a regular radial fashion around said through bore of said sight pin retaining means, the inwardly facing surfaces of said jaws configured to form a substantially cylindrical bore when in a closed condition, the outwardly facing surfaces of said jaws configured to form a substantially conical configuration when in said closed condition, and a tightening nut threadedly engaged with said retaining sleeve external threads and having a smooth conical locking portion at one end matching said configuration of said outwardly facing surfaces of said jaws whereby tightening of said tightening nut on said retaining sleeve external threads causes said conical locking portion of said tightening nut to seat against said locking jaws and force said jaws against said sight pin.

26. In an archery bow sight according to claim 25 wherein said sight pin retaining means additionally comprises an externally threaded lateral sight pin lock threadedly engaged in said internally threaded through bore of said retaining sleeve and a threaded locking nut threadedly engaged on said external threads of said lateral sight pin lock to retain said lateral sight pin lock in a set horizontal adjustment position.

* * * * *